US010100852B2

(12) United States Patent
Morreale et al.

(10) Patent No.: US 10,100,852 B2
(45) Date of Patent: Oct. 16, 2018

(54) BOLT RETAINER FOR PUMP FLUID END

(71) Applicant: FMC Technologies, Inc., Houston, TX (US)

(72) Inventors: John D. Morreale, Houston, TX (US); Alex D. Hollanshead, Houston, TX (US); Jason D. Smith, Spring, TX (US)

(73) Assignee: FMC Technologies, Inc., Houston, TX (US)

( * ) Notice: Subject to any disclaimer, the term of this patent is extended or adjusted under 35 U.S.C. 154(b) by 197 days.

(21) Appl. No.: 15/103,507

(22) PCT Filed: Dec. 30, 2013

(86) PCT No.: PCT/US2013/078250

§ 371 (c)(1),
(2) Date: Jun. 10, 2016

(87) PCT Pub. No.: WO2015/102562

PCT Pub. Date: Jul. 9, 2015

(65) Prior Publication Data

US 2016/0312808 A1 Oct. 27, 2016

(51) Int. Cl.
*F15B 15/24* (2006.01)
*F04B 1/04* (2006.01)
(Continued)

(52) U.S. Cl.
CPC ..... *F15B 15/24* (2013.01); *F04B 1/0404* (2013.01); *F04B 53/144* (2013.01); *F04B 53/16* (2013.01);
(Continued)

(58) Field of Classification Search
CPC ..... F04B 53/16; F04B 53/162; F15B 15/1428
See application file for complete search history.

(56) References Cited

U.S. PATENT DOCUMENTS 2,177,452 A 10/1939 Dempsey
2,520,459 A * 8/1950 Dohm ..... F16B 39/24 411/136

(Continued)

OTHER PUBLICATIONS

International Search Report issued in corresponding application No. PCT/US2013/078250 dated Jul. 10, 2014 (2 pages).

(Continued)

*Primary Examiner* — Thomas E Lazo
(74) *Attorney, Agent, or Firm* — Osha Liang LLP

(57) ABSTRACT

A pump including a power end (202) and a fluid end (204). A bore (214) extends through the fluid end (204). A rod (212) is disposed in the bore (214) of the fluid end (204) and extends into the power end (202). The rod (212) includes a reduced diameter portion (222) and the rod (212) is configured to connect the power end (202) and the fluid end (204). The pump also includes a retaining apparatus (216) coupled to the reduced diameter portion (222) of the rod (212). A shoulder (218) is formed between a first inner diameter (226) of the bore (214) and a second inner diameter (228) of the bore (214). The first inner diameter (226) is smaller than an outer diameter of the retaining apparatus (216). A first end (260) of the retaining apparatus (216) is configured to contact the shoulder (218) and a second end (262) of the retaining apparatus (216) is configured to contact a contact surface formed on the rod (212) in order to restrict movement of the rod (212) within the bore (214).

20 Claims, 5 Drawing Sheets

(51) Int. Cl.
*F04B 53/16* (2006.01)
*F04B 53/14* (2006.01)
*F15B 15/14* (2006.01)

(52) U.S. Cl.
CPC ..... *F04B 53/162* (2013.01); *F15B 15/1428* (2013.01); *F15B 15/1457* (2013.01)

(56) References Cited

U.S. PATENT DOCUMENTS

| | | | | |
|---|---|---|---|---|
| 5,127,807 | A * | 7/1992 | Eslinger ..... | F04B 11/0008 403/371 |
| 6,419,459 | B1 * | 7/2002 | Sibbing ..... | F04B 53/162 29/888.044 |
| 8,529,230 | B1 * | 9/2013 | Colley, III ..... | F04B 47/02 411/121 |
| 2003/0161746 | A1 | 8/2003 | Asayama et al. | |
| 2015/0147194 | A1 * | 5/2015 | Foote ..... | F04B 53/14 417/53 |

OTHER PUBLICATIONS

Written Opinion of the International Searching Authority issued in corresponding application No. PCT/US2013/078250 dated Jul. 10, 2014 (6 pages).
Office Action issued in Canadian Patent Application No. 2,933,905; dated Jun. 29, 2017 (3 pages).

* cited by examiner

BOLT RETAINER FOR PUMP FLUID END

BACKGROUND OF DISCLOSURE

Field of the Disclosure

Embodiments disclosed herein relate generally to a retaining apparatus for securing a fluid end tie bolt inside the fluid end of a pump. More particularly, embodiments disclosed herein relate to a retaining apparatus for securing a bolt, rod, or the like within the fluid end of a pump.

Description of the Related Art

Multi-cylinder reciprocating pumps typically include either the triplex (i.e., three cylinder) or the quintuplex (i.e., five cylinder) varieties, whereby each "cylinder" comprises a suction end and a discharge end. Ordinarily, a pair of one-way check-type valves are situated between the suction and discharge ends of each cylinder and are arranged such that fluid is drawn into the cylinder from the suction end through a first check valve, and then forced from the cylinder to the discharge end through a second check valve. A motor-driven plunger (i.e., piston) reciprocates within the cylinder alternating suction and discharge strokes with each complete rotation cycle of the crankshaft. Typically, the multiple cylinders of a multi-cylinder mud pump are timed such that the overall output of the pump is balanced and does not represent the overall pulsed nature that would be exhibited by a single-cylinder check valve pump.

Referring now to FIG. 1, a well service pump assembly 100 as would be commonly known in the prior art is shown. As depicted, pump assembly 100 includes a power end 102 and a fluid end 104. As would be understood by those having ordinary skill, the power end 102 comprises the driving assembly including an electric motor, a transmission (e.g., gear reducer) apparatus, and a crankcase housing a crankshaft and a plurality of connecting rods. In operation, the electric motor drives the transmission which, in turn, rotates the crankshaft attached to each of the piston plungers that reciprocate into and out of fluid end 104 of the pump assembly 100 through an inlet or suction manifold 106 and is discharged (under pressure) through a discharge outlet 108. As shown, a stud guard 110 is secured to an end of the fluid end 104 of pump assembly 100.

Referring now to FIG. 2, a perspective view of the fluid end 104 is shown. Stud guard 110 is placed on the fluid end 104 and retains the studs (not shown), in case a stud fails. The studs are used to compress and hold the power end 102 and the fluid end 104 together. The stud guard 110 is secured to the fluid end 104 by multiple stud guard fasteners 112. The fasteners 112 must be removed to uninstall the stud guard 110 and to access the studs, which might be removed during occasional maintenance and repair operations.

During an installation or repair operation, an operator uses a torque tool to load and unload the studs. As discussed above, the stud guard 110 may be secured to the fluid end 104 with fasteners 112 so that the ends of the studs (not shown), which extend through the fluid end 104, are covered. The stud guard 110 is used to retain the studs in case of a stud failure. However, the stud guard 110 must be removed before the studs are unloaded and the stud guard 110 must be placed on the fluid end 104 after the studs are loaded. Therefore, the technician that loads and unloads the studs does not benefit from the added safety of the stud guard 110.

SUMMARY

In one aspect, the present disclosure relates to a pump including a power end and a fluid end, a bore extending through the fluid end, a rod disposed in the bore of the fluid end and extending into the power end, a retaining apparatus coupled to the rod, and a shoulder formed between a first inner diameter of the bore and a second inner diameter of the bore. The first inner diameter is smaller than an outer diameter of the retaining apparatus. The retaining apparatus is configured to contact the shoulder and to restrict movement of the rod within the bore.

In another aspect, the present disclosure relates to an apparatus including a housing having a bore extending therethrough, a shoulder formed in the bore, a rod disposed in the bore, and a retaining apparatus coupled to a reduced diameter portion of the rod. A first end of the retaining apparatus is configured to contact the shoulder and a second end of the retaining apparatus is configured to contact a contact surface formed on the rod in order to restrict movement of the rod within the bore.

In another aspect, the present disclosure relates to a method including providing a rod including a reduced diameter portion and a large diameter portion, installing a retaining apparatus on the reduced diameter portion, connecting a first end of the rod to a power end of a pump, and inserting a second end of the rod through a bore in a fluid end of the pump. The bore includes a shoulder having an inner diameter. The method also includes restricting axial movement of the rod by contacting the shoulder with a first end of the retaining apparatus.

BRIEF DESCRIPTION OF DRAWINGS

Features of the present disclosure will become more apparent from the following description in conjunction with the accompanying drawings.

DETAILED DESCRIPTION

Embodiments disclosed herein relate to assemblies and methods to restrict movement of rods including, but not limited to, tie bolts or rods used pumps. More specifically, embodiments disclosed herein generally relate to a retaining mechanism for securing a bolt, rod, or the like to a fluid end of a pump.

Figure 1:
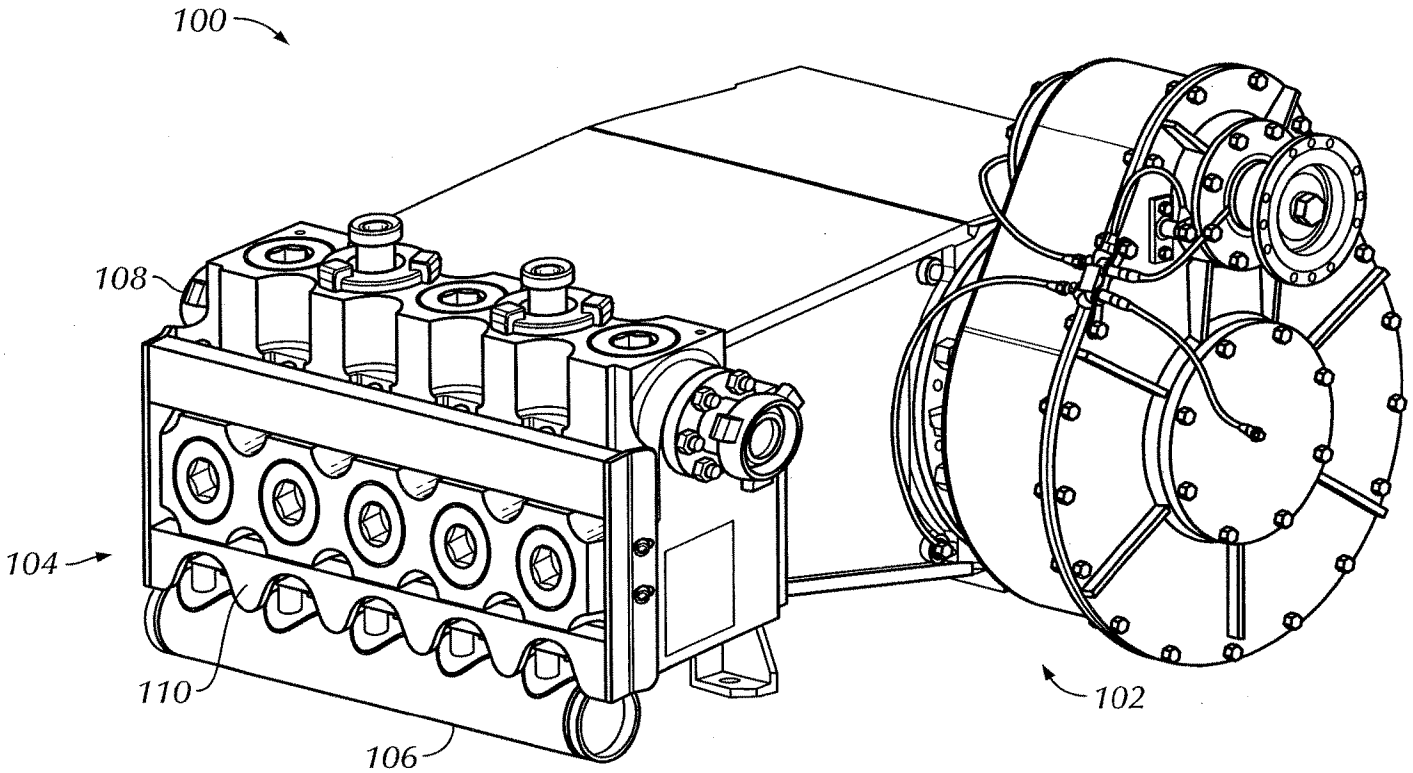
FIG. 1 (Prior Art)
FIG. 1 is a schematic profiled view drawing of a well service pump assembly.
Figure 2:
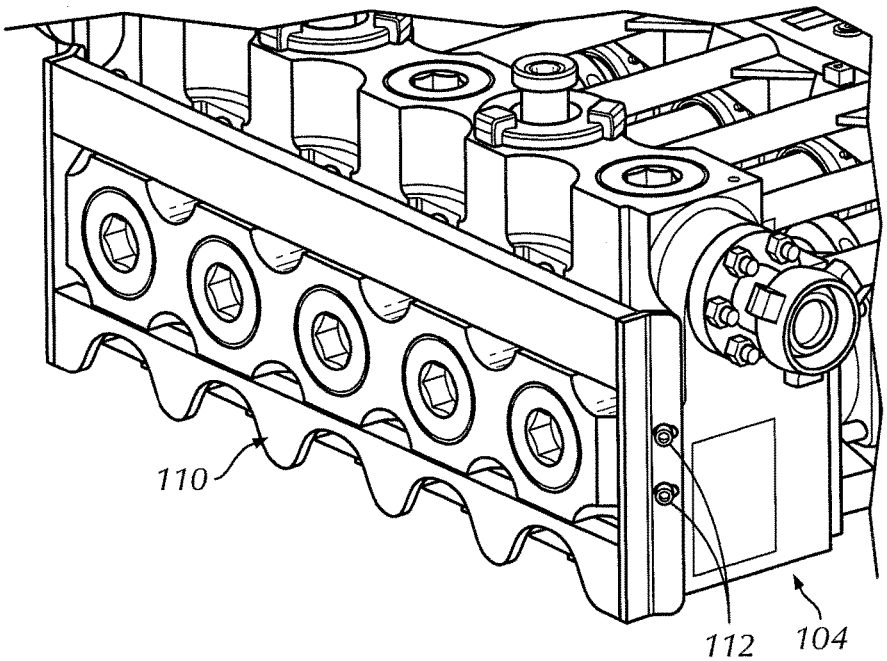
FIG. 2 (Prior Art)
FIG. 2 is a perspective view of a stud guard on a fluid end of the well service pump of FIG. 1.
Figure 3:
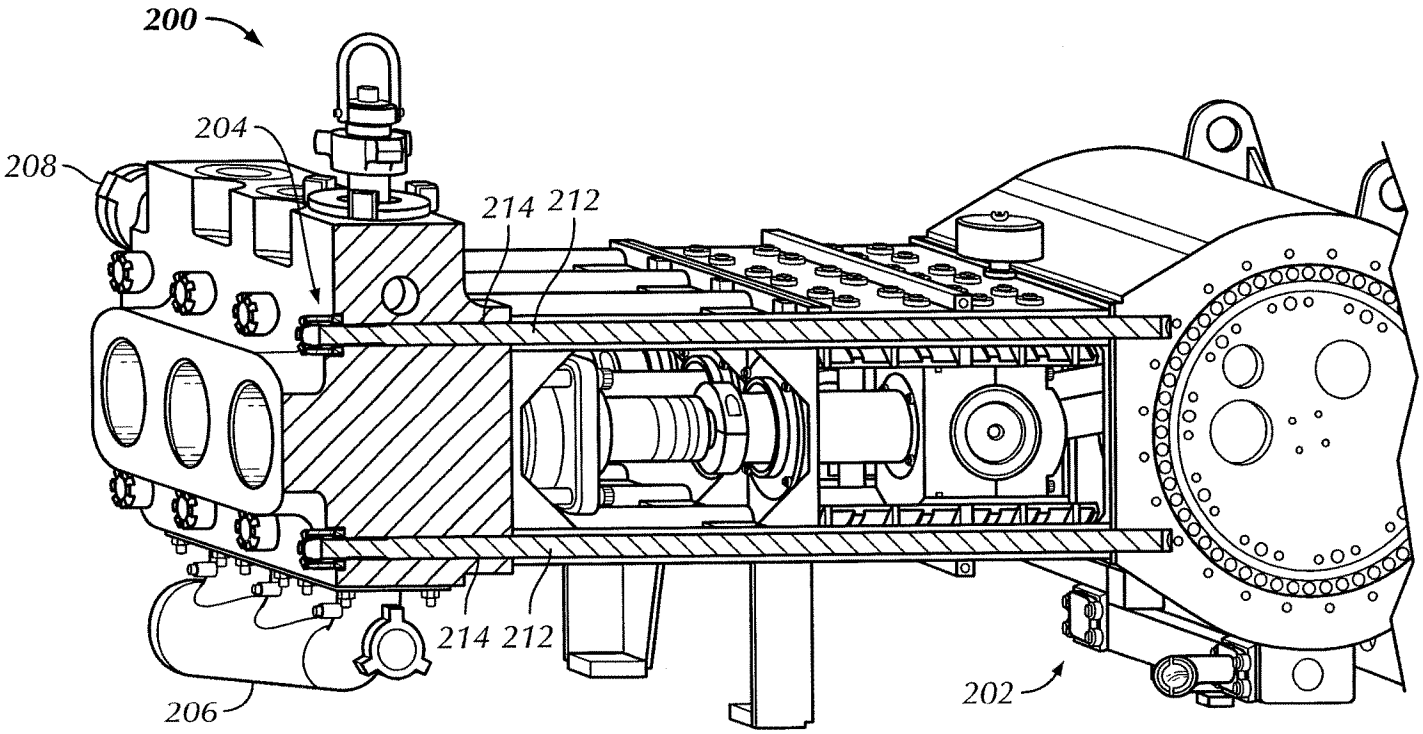
FIG. 3 is a perspective view of a pump assembly in accordance with one or more embodiments disclosed herein.

Referring now to FIG. 3, a pump assembly 200 is shown in a perspective cross-sectional view. As shown, the pump assembly 200 includes a power end 202 and a fluid end 204. The fluid end 204 has a bore 214 extending therethrough. The pump assembly 200 includes at least one rod 212 disposed between the power end 202 and the fluid end 204. The power end 202 receives a first end of the rod 212. At least a portion of a length of the rod is disposed in the bore 214. In one or more embodiments, the first end of rod 212 and the power end 202 may be threadedly engaged. The rod 212 compresses and holds the fluid end 204 and the power end 202 together. Bore 214 receives the rod 212 therein and a second end of rod 212 extends through the bore 214 and out of the fluid end 204.

In one or more embodiments, the fluid end 204 includes a suction manifold 206 that is connected to a bottom surface (not shown) of the fluid end 204. The fluid end 204 includes a discharge outlet 208 that projects from a side surface (not shown) of the fluid end 204.

Figure 4:
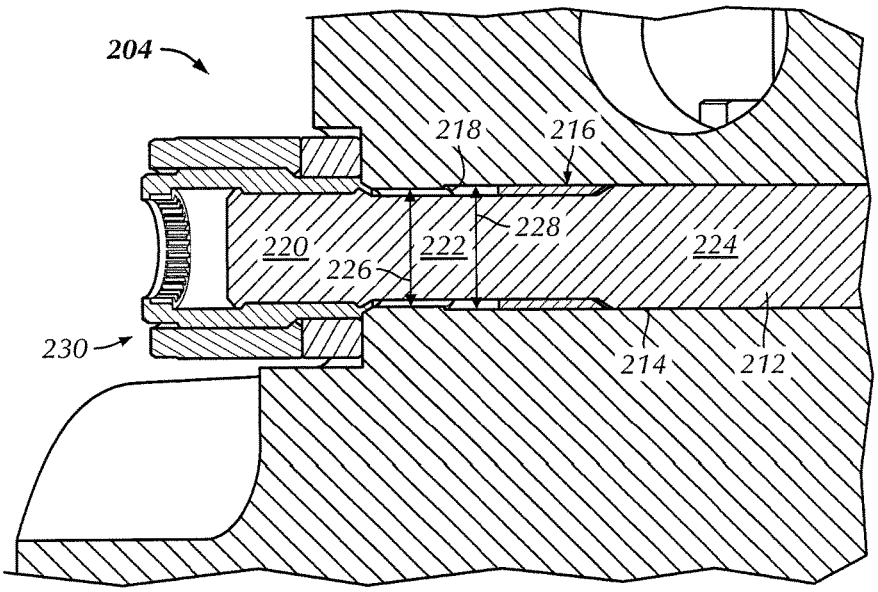
FIG. 4 is a cross-sectional view of the fluid end of the pump assembly of FIG. 3.

Referring now to FIG. 4, a cross-sectional view of the fluid end 204 of pump 200 is shown. As shown in FIG. 4, the rod 212 has an end section 220 connected to the fluid end 204, a reduced diameter portion 222, and at least one large diameter portion 224. A retaining apparatus 216 is placed on the reduced diameter portion 222 of rod 212. In one or more embodiments, the retaining apparatus 216 is a hollow cylindrical body with a removed circumferential portion, so that it forms a "C" shape, when viewed from an axial end thereof. The retaining apparatus 216 fits or snaps over the reduced diameter portion 222 of rod 212 in order to couple the retaining apparatus 216 to the rod 212. The retaining apparatus 216 encompasses a portion of the circumference of the reduced diameter portion 222 of rod 212.

The bore 214 has a first inner diameter 226 and a second inner diameter 228. In one embodiment, the first inner diameter 226 of bore 214 is smaller than the second inner diameter 228 of bore 214. The second inner diameter 228 of bore 214 is closer to the power end 202 than the first inner diameter 226 of bore 214. In other words, at least a portion of the diameter of the bore 214 is smaller than at least a portion of the diameter of the bore 214 toward the power end 202 of the pump, thereby providing a stepped feature in the fluid end 204 of the pump. The stepped feature is a shoulder 218 formed within the bore 214 between the first inner diameter 226 and the second inner diameter 228 thereof. In one embodiment, the bore 214 receives the rod 212 such that the retaining apparatus 216 and the reduced diameter portion 222 are located within the bore. In other embodiments, a portion of the retaining apparatus 216 and the reduced diameter portion 222 of rod 212 may extend out of an end of the bore 214 that faces the power end 202. The large diameter portion 224 of rod 212 is disposed in the bore 214.

The end section 220 of rod 212 extends from the fluid end 204. A sleeve assembly 230 is disposed on the end section 220 of the rod 212. The sleeve assembly 230 is configured to couple the rod 212 to the fluid end 204 of the pump 200 and to apply tension to the rod 212. A torque load applied to the sleeve assembly 230 disposed on the end section 220 results in a tension load applied to the rod 212, which compresses the power end 202 and fluid end 204 together.

Figure 5:
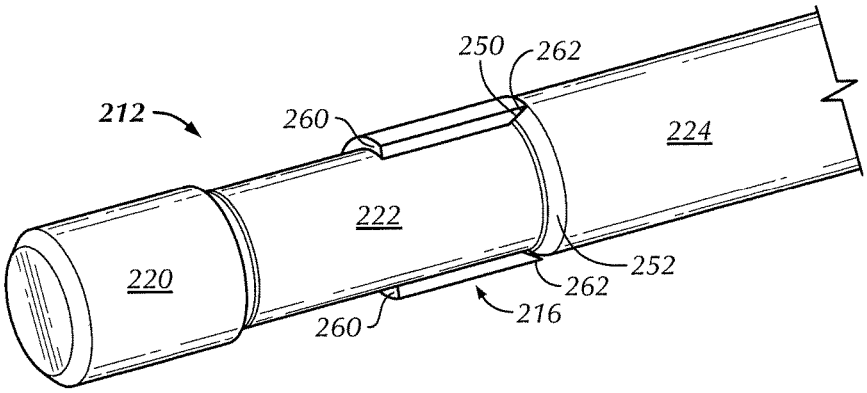
FIG. 5 is a perspective view of a retaining ring and a rod of the pump assembly of FIG. 3.

Referring now to FIGS. 4 and 5, the rod 212 is shown with the retaining apparatus 216 coupled thereto in accordance with one or more embodiments disclosed herein. As shown, the reduced diameter portion 222 is formed on the rod 212 between the large diameter portion 224 and the end section 220. A contact surface 252 is formed on the rod 212 between the reduced diameter portion 222 and the large diameter portion 224. The contact surface 252 may be a shoulder formed between the reduced diameter portion 222 and the large diameter portion 224. In one embodiment, the contact surface 252 comprises at least one of an angled surface, a beveled surface, a flat surface, and a rounded surface. The retaining apparatus 216 has a first end 260 and a second end 262. The second end 262 of retaining apparatus 216 includes a corresponding contact surface 250 that corresponds to the contact surface 252 of rod 212. In one embodiment, the corresponding contact surface 250 on the second end 262 of retaining apparatus 216 is configured to contact abut the contact surface 252 of rod 212.

In one embodiment, the retaining apparatus 216 is configured to restrict movement of the rod 212 in an axial direction along an axial length of the rod 212. The first end 260 of retaining apparatus 216 is configured to contact or abut the shoulder 218 formed on the bore 214. The first end 260 contacts the shoulder 218 when the retaining apparatus 216 moves in an axial direction (i.e., along the length of the rod 212) away from the power end 202. In one embodiment, axial movement of the retaining apparatus 216 is caused by contact surface 252 of rod 212 contacting or striking corresponding contact surface 250 formed on second end 262 of retaining apparatus 216. Axial movement of the retaining apparatus 216 is restricted by the first end 260 of retaining apparatus 216 abutting the shoulder 218 formed on the bore 214. Thus, as the rod 212 moves axially away from the power end 202, the contact surface 252 of rod 212 moves into contact engagement with the corresponding contact surface 250 of the second end 262 of the retaining apparatus 216. As the rod 212 continues to move axially away from the power end 202, the first end 260 of the retaining apparatus 216 moves into contact engagement with the shoulder 218 formed in the bore 214 of the fluid end 204, thereby restricting further movement of the rod 212 in the axial direction away from the power end 202. One of ordinary skill in the art will appreciate that in some embodiments the retaining apparatus 216 may be moved into contact engagement with the shoulder 218 before the contact surface 252 of the rod 212 moves into contact engagement with the retaining apparatus 216. Thus, in the event that the rod 212 fails due to, for example, mechanical stress in the rod 212 exceeding a critical limit, axial movement of the rod 212 away from the power end 202 is restricted.

Figure 6:
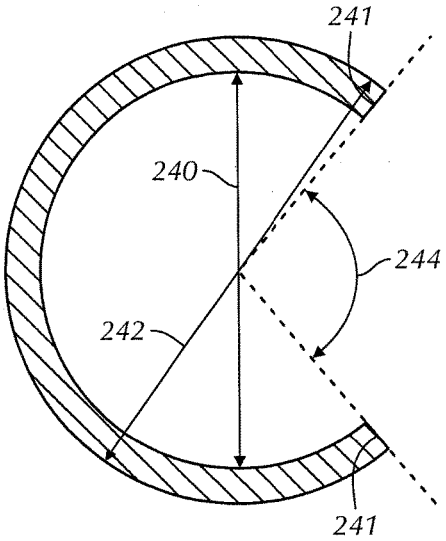
FIG. 6 is a cross-sectional view of the retaining ring of FIG. 5.

Referring now to FIG. 6, a cross-sectional view of the retaining apparatus 216 in accordance with embodiments disclosed herein is shown. As shown, the retaining apparatus 216 may be a hollow cylindrical body formed into a "C" shape when viewed from an axial end of the retaining apparatus 216. The retaining apparatus 216 has axial edges 241 that are formed on each end of the "C" shape of the retaining apparatus 216. The retaining apparatus 216 has an inner diameter 240 and an outer diameter 242. The outer diameter 242 of retaining apparatus 216 is smaller than the second inner diameter portion 228 (FIG. 4) of bore 214 (FIG. 4). The outer diameter 242 of the retaining apparatus 216 is larger than the first inner diameter 226 (FIG. 4) of bore 214 (FIG. 4).

An angle 244, as shown, measures the angle between the axial edges 241 of retaining apparatus 216, as measured from a center of the retaining apparatus 216. In certain embodiments, the angle 244 is within a range of approximately 25 and 165 degrees. In some embodiments, the angle 244 is within a range of approximately 60 degrees and 150 degrees. In some embodiments, the angle 244 is approximately 120 degrees.

Figure 7:
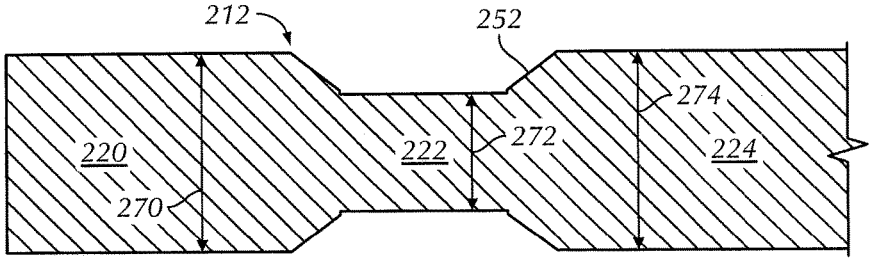
FIG. 7 is a cross-sectional view of the rod of FIG. 5.

Referring now to FIG. 7, a cross-sectional view of the rod 212 is shown. The end section 220 of rod 212 is shown having a first diameter 270. The reduced diameter portion 222 of rod 212 has a diameter 272 that is smaller than the first diameter 270. The large diameter portion 224 of rod 212 has a second diameter 274. The reduced diameter portion 222 is formed on the rod 212 between the end section 220 and the large diameter portion 224.

In one or more embodiments, the first diameter 270 of end section 220 is substantially the same as the second diameter 274 of large diameter portion 224. In other embodiments, the first diameter 270 of end section 220 is smaller than the second diameter 274 of large diameter portion 224. In other embodiments, the first diameter 270 of end section 220 is larger than the second diameter 274 of large diameter portion 224. The first diameter 270 of end section 220 is larger than the diameter 272 of reduced diameter portion 222 of rod 212. The first diameter 270 of end section 220 is smaller than the first inner diameter 226 (FIG. 4) of bore 214 (FIG. 4). The diameter 272 of reduced diameter portion 222 is substantially the same as the inner diameter 240 (FIG. 6) of retaining apparatus 216 (FIG. 6). The second diameter 274 of large diameter portion 224 is smaller than the outer diameter 242 (FIG. 6) of retaining apparatus 216 (FIG. 6). The second diameter 274 of large diameter portion 224 is smaller than the second inner diameter 228 (FIG. 4) of bore 214 (FIG. 4).

With reference to FIGS. 3-7 together, the installation and use of the retaining apparatus 216 with the pump assembly 200 is now discussed. The rod 212 is formed having end section 220, reduced diameter portion 222, and larger diameter portion 224. A contact surface 252 may be formed on the rod 212 between the reduced diameter portion 222 and larger diameter portion 224. One of ordinary skill in the art will appreciate that the rod 212 having various diametrical dimensions may be formed by any methods known in the art, including for example molding, machining, forging, casting, cold working, or hot working. One of ordinary skill in the art will appreciate that the retaining apparatus 216 having various diametrical dimensions may be formed by any methods known in the art, including for example molding, machining, forging, casting, cold working, and hot working. In one embodiment, the retaining apparatus 216 is formed as a c-shaped ring. In one embodiment, the retaining apparatus 216 is formed as a split ring.

The retaining apparatus 216 is installed on the reduced diameter portion 222 of the rod 212. In some embodiments, the retaining apparatus 216 is a c-shaped ring or split ring that is configured to snap or fit over the reduced diameter portion 222 of the rod 212 in order to couple the retaining apparatus 216 to the rod 212. The retaining apparatus 216 is installed on the reduced diameter portion 222 of the rod 212 prior to inserting the rod 212 into bore 218. A first end of the rod 212 is connected to the power end 202 of pump 200. In one or more embodiments, the first end of the rod 212 is threadedly connected to the power end 202.

The rod 212 with the retaining apparatus 216 is installed in the fluid end 204 of the pump 200. Shoulder 218 has a first inner diameter 226. A second end of the rod 212 is inserted through the bore 214 in the fluid end 204 of pump 200. The reduced diameter portion 222 with the retaining apparatus 216 disposed thereon is located proximal the second end of the rod 212. The sleeve assembly 230 is installed on the end section 220 of rod 212. Applying a torque load to the sleeve assembly 230 compresses the power end 202 and the fluid end 204 together. The sleeve assembly 230 is configured to convert the applied torque load to axial tension in the rod 212.

Finally, in one or more embodiments, axial movement of rod 212 is restricted by contacting the shoulder 218 with the end 260 of retaining apparatus 216, and by contacting the contact surface 252 of rod 212 with the corresponding contact surface 250 of retaining apparatus 216. In one embodiment, axial movement of the rod 212 may be caused by failure of the rod 212, which may be caused, for example, by tension or torque in the rod exceeding a critical limit. The retaining apparatus 216 comprises a c-shape when viewed from an axial end thereof, such that when the retaining apparatus 216 is disposed on the rod 212 a circumferential portion of the rod 212 is not covered by the retaining apparatus 216.

In one or more embodiments, the retaining apparatus 216 is configured to fit or snap over the reduced diameter portion 222 formed on the rod 212, in order to couple the retaining apparatus 216 to the reduced diameter portion 222 of the rod 212. The c-shaped retaining apparatus 216 allows the retaining apparatus 216 to fit or snap over the reduced diameter portion 222 of the rod 212. One of ordinary skill in the art will appreciate that the retaining apparatus 216 and the rod 212 may be formed from any material known in the art, for example, alloy steel, aluminum, other metals, composites, ceramics, and polymers.

Advantageously, apparatus and method embodiments disclosed herein may provide additional safety to a technician that loads and unloads tie bolts or rods in a pump. Embodiments disclosed herein provide a retaining apparatus that restricts movement of a tie bolt or rod and prevents the rod from exiting the fluid end housing and becoming a projectile in the event of failure of the rod. Embodiments disclosed herein advantageously provide a safety measure during operation of the pump and during repair or maintenance operations. Thus, should the rod experience failure, the retaining apparatus will restrict axial movement of the rod and prevent the rod from exiting the fluid end of a pump, in order to prevent the rod from becoming a projectile.

While the disclosure has been presented with respect to a limited number of embodiments, those skilled in the art, having benefit of this disclosure, will appreciate that other embodiments may be devised which do not depart from the scope of the present disclosure. Accordingly, the scope of the application should be limited only by the attached claims.

What is claimed is:

1. A pump comprising:

a power end and a fluid end;

a bore extending through the fluid end;

a rod disposed in the bore of the fluid end and extending into the power end, the rod comprising a reduced diameter portion;

a retaining apparatus coupled to the rod; and a shoulder formed between a first inner diameter of the bore and a second inner diameter of the bore, wherein the first inner diameter is smaller than an outer diameter of the retaining apparatus, wherein the retaining apparatus has a first end located a first distance from the shoulder in a first position, and wherein the first end of the retaining apparatus contacts the shoulder in a second position to restrict movement of the rod within the bore.

2. The pump of claim 1, wherein the retaining apparatus is coupled to the reduced diameter portion of the rod.

3. The pump of claim 1, wherein movement of the rod is restricted when the first end of the retaining apparatus in the second position abuts the shoulder and a contact surface of the rod abuts a second end of the retaining apparatus.

4. The pump of claim 1, wherein the retaining apparatus is a hollow cylindrical body.

5. The pump of claim 1, wherein the retaining apparatus comprises a c-shaped ring.

6. The pump of claim 1, wherein the rod includes at least one large diameter portion comprising a diameter that is smaller than the second inner diameter of the bore.

7. The pump of claim 1, wherein the retaining apparatus further comprises:

a second end closer to the power end than the first end, wherein the second end of the retaining apparatus is in contact engagement with a surface on the rod.

8. The pump of claim 1, wherein the retaining apparatus covers a circumferential portion of the reduced diameter portion of the rod.

9. An apparatus comprising:

a housing having a bore extending therethrough;

a shoulder formed in the bore;

a rod disposed in the bore, wherein the rod comprises a reduced diameter portion and at least one large diameter portion; and a retaining apparatus coupled to the reduced diameter portion of the rod, wherein a first end of the retaining apparatus is located a first distance from the shoulder in a first position and is configured to contact the shoulder in a second position and a second end of the retaining apparatus is configured to contact a contact surface formed on the rod in order to restrict movement of the rod within the bore.

10. The apparatus of claim 9, wherein an outer diameter of the retaining apparatus is larger than an inner diameter of the shoulder.

11. The apparatus of claim 9, wherein a diameter of the least one large diameter portion is smaller than an inner diameter of the bore.

12. The apparatus of claim 9, wherein the retaining apparatus is configured to restrict movement of the rod in the event that the rod fails.

13. The apparatus of claim 9, wherein the retaining apparatus is a hollow cylindrical body.

14. The apparatus of claim 9, wherein the retaining apparatus comprises a c-shaped split ring.

15. A method comprising:

providing a rod comprising a reduced diameter portion and a large diameter portion;

installing a retaining apparatus on the reduced diameter portion;

connecting a first end of the rod to a power end of a pump;

inserting a second end of the rod through a bore in a fluid end of the pump, wherein the bore comprises a shoulder having an inner diameter, wherein a first end of the retaining apparatus is located a first distance from the shoulder in a first position; and restricting axial movement of the rod by contacting the shoulder with the first end of the retaining apparatus in a second position.

16. The method of claim 15, further comprising:

moving at least a portion of the rod axially away from the power end of the pump, wherein the portion of the rod moves in response to the rod failing;

wherein axial movement of the rod is restricted by contacting a contact surface of the rod with a second end of the retaining apparatus and by contacting the shoulder with the first end of the retaining apparatus.

17. The method of claim 15, further comprising applying a torque to the rod to compress the fluid end and the power end.

18. The method of claim 15, further comprising providing the retaining apparatus with an outer diameter larger than the inner diameter of the shoulder.

19. The method of claim 15, wherein the restricting axial movement further comprises contacting a second end of the retaining apparatus with a contact surface formed on the rod between the reduced diameter portion and the large diameter portion.

20. The method of claim 15 further comprising installing the retaining apparatus on the reduced diameter portion prior to inserting the second end of the rod through the bore.

* * * * *